US010549325B2

(12) United States Patent
Lund

(10) Patent No.: US 10,549,325 B2
(45) Date of Patent: Feb. 4, 2020

(54) METHOD AND SYSTEM FOR REMOVING DEPOSITS WITHIN A PIPE OR PIPELINE

(71) Applicant: EMPIG AS, Trondheim (NO)

(72) Inventor: Fredrik Lund, Trondheim (NO)

(73) Assignee: EMPIG AS, Trondheim (NO)

( * ) Notice: Subject to any disclaimer, the term of this patent is extended or adjusted under 35 U.S.C. 154(b) by 76 days.

(21) Appl. No.: 15/033,123

(22) PCT Filed: Oct. 17, 2014

(86) PCT No.: PCT/EP2014/072286
§ 371 (c)(1),
(2) Date: Apr. 29, 2016

(87) PCT Pub. No.: WO2015/062878
PCT Pub. Date: May 7, 2015

(65) Prior Publication Data

US 2016/0279684 A1 Sep. 29, 2016

(30) Foreign Application Priority Data

Oct. 30, 2013 (NO) ..... 20131438

(51) Int. Cl.
*B08B 9/027* (2006.01)
*B08B 7/00* (2006.01)
(Continued)

(52) U.S. Cl.
CPC ..... *B08B 9/027* (2013.01); *B08B 1/001* (2013.01); *B08B 7/0071* (2013.01); *B08B 7/028* (2013.01);
(Continued)

(58) Field of Classification Search
CPC ..... B08B 9/027; B08B 17/02; B08B 1/001; B08B 9/023; B08B 7/028; B08B 7/02; B08B 7/0071; B08B 17/00; E21B 43/36
(Continued)

(56) References Cited

U.S. PATENT DOCUMENTS 3,843,409 A * 10/1974 Ice ..... F28G 9/00 134/34
6,939,082 B1 * 9/2005 Baugh ..... B08B 7/0071 405/145
(Continued)

FOREIGN PATENT DOCUMENTS

FR 2 630 934 A1 11/1989
GB 2 141 201 A 12/1984
(Continued)

OTHER PUBLICATIONS

International Search Report issued in corresponding application No. PCT/EP2014/072286 dated Dec. 2, 2014 (3 pages).
(Continued)

*Primary Examiner* — Binh X Tran
*Assistant Examiner* — Christopher Remavege
(74) *Attorney, Agent, or Firm* — Osha Liang LLP

(57) ABSTRACT

A fluid flow processing plant for pig-free removal of wax and hydrate deposits in hydrocarbon production flowlines may include at least one cooling flowline. Further, the fluid flow processing plant my include cooling means arranged to cool the fluid in the at least one cooling flowline over a cooling section until the fluid reaches a temperature at or near the cooling flowline's surrounding temperature ($T_{sea}$) and at least one vehicle arranged on or near the outer circumference of the cooling flowline. Furthermore, each vehicle may include at least one sleeve configured to at least partly surround an outer circumference of the cooling flow-
(Continued)

line, deposit removing means being configured to remove deposits situated on an inner wall of the cooling flowline, and a propulsion unit configured to drive the vehicle bi-directionally on the cooling flowline.

12 Claims, 8 Drawing Sheets

(51) Int. Cl.

| | |
|---|---|
| ***B08B 1/00*** | (2006.01) |
| ***B08B 7/02*** | (2006.01) |
| ***B08B 9/023*** | (2006.01) |
| ***B08B 17/02*** | (2006.01) |
| ***E21B 43/36*** | (2006.01) |

(52) U.S. Cl.
CPC ..... *B08B 9/023* (2013.01); *B08B 17/02* (2013.01); *E21B 43/36* (2013.01)

(58) Field of Classification Search
USPC .... 134/1, 15, 17, 18, 19, 22.1, 22.11, 22.18, 134/56 R, 57 R, 58 R, 105, 137, 140, 134/166 R, 167 R, 168 R, 169 R, 166 C, 134/167 C, 168 C
See application file for complete search history.

(56) References Cited

U.S. PATENT DOCUMENTS 8,424,608 B1 * 4/2013 Lugo ..... E21B 36/005 166/302
8,555,978 B2 * 10/2013 Ganelin ..... E21B 17/01 166/344
9,327,810 B2 * 5/2016 Zediker ..... B63G 8/001
9,605,916 B2 * 3/2017 Stickling ..... F28G 15/02
10,018,432 B2 * 7/2018 Stickling ..... F28G 15/02
2003/0217422 A1 * 11/2003 Tsai ..... B08B 9/0436 15/104.05
2005/0061512 A1 * 3/2005 Reid ..... E21B 33/037 166/335
2010/0300486 A1 * 12/2010 Hoffman ..... B08B 9/027 134/8
2012/0073823 A1 * 3/2012 McClanahan ..... B01D 19/0073 166/344
2013/0233350 A1 * 9/2013 Tomkins ..... B08B 9/023 134/12
2013/0298937 A1 * 11/2013 O'Donnell ..... E03C 1/30 134/1
2015/0367387 A1 * 12/2015 Alcuri ..... G01N 17/008 405/184.1

FOREIGN PATENT DOCUMENTS

WO 2009/051495 A1 4/2009
WO 2010/087724 A1 8/2010
WO 2012/093079 A2 7/2012

OTHER PUBLICATIONS

Written Opinion issued in corresponding application No. PCT/EP2014/072286 dated Dec. 2, 2014 (6 pages).
Norwegian Search Report issued in application No. 20131438 dated May 21, 2014 (2 pages).

* cited by examiner

A-A

METHOD AND SYSTEM FOR REMOVING DEPOSITS WITHIN A PIPE OR PIPELINE

FIELD OF THE INVENTION

The invention relates to an apparatus and a method that removes deposits on the inside and/or outside walls of pipes as set out in the introduction to the independent claims.

BACKGROUND OF THE INVENTION

Pipelines that are used to transport products such as petroleum, gas or other fluids can become blocked or inefficient through the build up of deposits on the pipe walls. The deposits can be foreign material, detritus, or natural waste products such as, for example, paraffin, calcium, wax, hydrates, scaling, naftenat and asphaltenes. In order to remove these undesired deposits pipes and pipelines in general require cleaning, testing or gauging. A well known technique to obtain such removal is to use a so-called "pig" (Pipe Inspection Gauge). The pig is designed to fit closely within the pipe and is caused to travel along the pipe by admitting fluid under pressure behind the pig. During the travel the deposits are removed from the inner surface by scraping or brushing, or simply by pushing the deposits ahead of it as it travels to a point where it can be removed along with the released deposits. Such mono-directional pigs, which are transported along with the fluid flow, may become stuck when it encounters large amounts of pipe wall deposits, and thus form a permanent plug in the pipeline. Examples of traditional mono-directional pigs may be found in GB 2,141,201 A or FR 2,630,934 A1. Very recently bi-directional pigs have been demonstrated suitable for removing deposits within subsea hydrocarbon production flowlines, see WO 2012/093079 A2.

Removal of deposits is particularly important in the oil and gas industry. Severe problems often occur when hydrocarbon fluids are transported in long subsea pipelines at large depths and in cold waters. Such problems may include the formation of obstructions in the pipeline, in the form of hydrates or other deposits such as ice, wax and debris (e.g. asphaltenes, sand). The initially warm well fluid is cooled down by cold seawater, thereby inducing condensation, precipitation and hydrate and wax formation/crystallization. Below is a non-exhausting number of known methods disclosed that often are employed for removing the undesired wax and hydrate formation, or preventing the formation of such:

- Adding chemicals (such as antiscaling corrosion inhibitors, wax inhibitors, methanol or mono-ethylene glycol; MEG) to the well fluids.
- Using direct electric heating (DEH), i.e. arranging electrical cables along the pipeline in order to maintain the well fluids at a temperature above the temperature at which wax precipitates ("wax appearance temperature"—WAT). A typical arrangement is an extra cable placed piggy back or besides the production pipe with an effect of several megawatt (typically 30-40 MW).
- Thermal insulation in the form of applying thermal (insulation) around the pipeline and/or burying it in the seabed. Alternatively a pipe-in-pipe configuration or thick layer of PP (solid polypropylene foam) or PP (foam) or PUR (polyurethane) extruded around the pipes outer surface.
- Rock dumping and dredging of pipelines, mainly performed to insulate the pipes further, thus keeping the flow warm.

- Using a pig, as described above.

Several disadvantages have been associated the use of pigs. A pigging system typically comprises a pig launching station and a retrieving station, each comprising an assembly of isolation valves, a trap barrel, an entry hatch and a bypass valve, enabling an operator to launch a pig (by support of a vessel) into the pipeline safely and to retrieve it at the other end. The trap barrels are generally closed at one end and situated outside the main pipeline. The system tends to take up a large volume and is heavy. Pigs are also launched from a top side facility (platform or land) and two costly production pipes are thus needed (pig loop) instead of just one. Also, the well stream production must in many cases be reduced in order not to impose too high pressure on the pig. As mentioned above it has recently been published a bi-directional pig apparatus that overcome these shortcomings. This pig apparatus disclosed in WO 2012/093079 A2 comprises a pig arranged for movement inside a pipe and includes a tubular body having a longitudinal axis coinciding with the central axis of the pipe and a through-going opening allowing fluids in the pipe to flow through the body. The pig apparatus also comprises propulsion means arranged and configured for imparting a motive force to the pig to allow the pig to move inside the pipe portion independently of the fluid flow. However, this system still necessitates a movable pig inside the pipe and propulsion means to impart the required pig movements, setting a complexity level that may prove costly and cumbersome. Even with the novel bi-directional plug operations based on plugging will face the risk of operational challenges such as pig obstruction due to excessive deposit formation.

With the exception of the pig apparatus disclosed in WO 2012/093079 A2 the measures taken to prevent formation or hydrate and wax deposits today have clear limits when it comes to transportation distance. The longer the pipe, the higher the cost.

A simple and reliable system for ensuring subsea transport of hydrocarbons over long distances is to allow so-called "cold flow". If the well stream fluids, pipeline wall and the ambient seawater all are at the same or similar temperature, wax deposits do not form on the interior pipe wall surface, but are transported together with the well fluid without problems. Cold flow is normally achieved by allowing the well stream to be cooled to ambient seawater temperature simply by heat exchange through the pipeline wall. However, severe hydrate and wax formation will take place in the pipeline section where cooling takes place. This relatively short cooling section, typically 1000 m or less, will therefore have to go through deposit removing operations on a more frequently basis, for example by using the above mentioned pigs as disclosed in WO 2012/093079 A2 or by statically exposing the relevant section to heating for short period of time as disclosed in WO 2009/051495.

It is therefore a need for an apparatus and a method that removes deposits, particularly on the inside walls of pipe sections, in areas with excessive amount of deposits, for example around the cooling sections in case of the "cold-flow" process, and which overcome shortcomings of the prior art and obtains further advantages.

SUMMARY OF THE INVENTION

The invention is set forth and characterized in the main claims, while the dependent claims describe other characteristics of the invention.

In particular, the invention concerns a fluid flow processing plant and a method for pig-free removal of wax and hydrate deposits in hydrocarbon production flowlines or pipes/pipelines. The plant comprises at least one cooling flowline and cooling means arranged to cool the fluid in the cooling flowline(s) over a cooling section until the fluid reaches a temperature at or near the cooling flowline's surrounding/ambient temperature, thereby significantly reducing or eliminating the possibility of the deposits to stick to the inner walls of the flowlines. The plant further comprises at least one vehicle arranged on at least one of the at least one cooling flowline, where each vehicle, or some of the vehicles, comprise(s) at least one sleeve/segment configured to at least partly surround the outer circumference of the cooling flowline, deposit removing means at or near the outer circumference of the cooling flowline, the deposit removing means being configured to remove deposits situated on the inner wall of the cooling flowline, and a propulsion unit configured to drive the vehicle bi-directionally on the cooling flowline. The cooling section is defined as the area of the cooling flowline(s) in which the through passing fluid experiences a cooling due to the imposed cooling mechanism as will be explained in more details below.

The inventive plant should be suitable for subsea hydrocarbon production, but may advantageously also be suitable for top-side or onshore production.

At least one of the at least one vehicle is preferably retrievable, for example by use of a ROV in case of subsea production, for example by connecting the respective vehicle to the outer circumference of the respective cooling flowline by a hinged clamp-on technique, by magnets, etc.

Further, the deposit removing means may comprise heating means configured to heat the inner walls of the cooling flowline, thereby allowing heat induced removal of deposits. The heating means may advantageously be configured to heat the inner wall by heat pulses of finite time durations in order to avoid melting of the deposits to be released. The duration of the heat pulses is preferably set to be long enough to remove a major part of the deposit from the inner wall within the cooling section. At the same time the duration is preferably short enough, and/or the intensity is preferably low enough, to avoid any substantial melting of a major part of the deposit within the cooling section. Alternatively, or in addition to heating means, the deposit removing means may comprise vibration means configured to cause vibrations of the inner wall of the cooling flowline, thereby allowing vibration induced removal of deposits. In the latter case the frequencies of a major part of the vibrations set off by the vibration means lie preferably within the ultrasonic range. The formulation "a major part" signifies in this application a part constituting more than 50% of the total frequency range.

The induced release of deposits may also be achieved by allowing at least one of the at least one vehicle to traverse the relevant part(s) of the cooling flowline with a predetermined speed and a predetermined setting of the heating and/or vibration. For example, in order to obtain favourable heat exposure the vehicle(s) is/are set with a continuous heating effect and a constant speed, or with a continuous heating effect and a variable speed. The latter parameter may also function as a replacement or an addition to any setting/adjustment of the heat pulse time durations under an optimization procedure.

In an alternative embodiment of the invention the propulsion unit is self-sustained, for example by means of one or more dedicated batteries connected to mechanical systems based on pitch rack between flowlines, winch systems, dedicated wheels on the vehicles, etc. The propulsion system may also be a magnetic force generated within the vehicle by a dedicated magnetic system. Such a propulsion unit may comprise thrusters, for example thrusters normally used in ROV.

In yet a preferred embodiment of the invention the plant further comprises dedicated charging means for the vehicle(s), for example by means of umbilicals and/or dedicated station(s) distributed close to or on the cooling flowlines, that may provide inter alia power and communication signals.

In yet a preferred embodiment of the invention the plant comprises several vehicles on each of the at least one cooling flowlines, each operating in dedicated section(s) of its respective cooling flowline.

In yet a preferred embodiment of the invention the plant further comprises a feed flowline fluidly connectable to a fluid reservoir and an export flowline, wherein the at least one cooling flowline is fluidly connecting the feed flowline with the export flowline.

The cooling flowline(s) constituting the cooling section may be configured in various manners such as in parallel, helical/spiral, elevated or a combination thereof. In a preferred embodiment of the invention the plant comprises a plurality of cooling flowlines, for example arranged substantially parallel with each other and/or stacked vertically. The plurality of cooling flowlines may be connected to the feed flowline and the export flowline via an inlet manifold and an outlet manifold, respectively, where each one of the plurality of cooling flowlines comprises the vehicle or vehicles.

In yet a preferred embodiment of the invention the plant is, during use, supported on the seabed below a body of water and connected in fluid communication with one or more subterranean fluid reservoirs producing a hydrocarbon containing flow having a temperature which is higher than the ambient seawater temperature. The plant may be situated directly on the seabed or be lifted above the seabed by a frame structure or a combination thereof.

In yet a preferred embodiment of the invention the plant further comprises a return line used for example to boost production and/or to feed seed particles therethrough. The return line is in this embodiment fluidly connected between the export flowline and the feed flowline adjacent to the inlet of the cooling flowline(s). The return line may advantageously also comprise pumping means and valve means, whereby a portion of the flow in the export flowline may be fed into the flow upstream of the at least one cooling flowline. In this way the colder fluid in the export flowline exiting the cooling flowline(s) will act as a cooling agent for the warmer fluid in the feed flowline entering the cooling flowline(s). A beneficial effect of feeding a fraction of the cooled fluids into the warm well stream in the feed flowline before it enters the cooling flowline(s) is obtained by introducing comparably dry hydrate seed particles into the flow. These dry particles are in effect condensations seed particles for gas hydrates forming kernels for the further particle growth. Thus, inert and dry hydrate particles are suspended in the liquid phase as the well stream enters the cooling section, yielding less deposit in the cooling flowline(s). Dry hydrates are not as problematic as adhesive hydrate slurry or wet hydrate formed on water molecules. The return line may optionally be furnished with an inside situated pig in accordance with prior art, for example as disclosed in WO 2012/093079. In case of subsea hydrocarbon production the ideal fluid temperature within the cooling flowline(s) (i.e. in order to obtain the above mentioned beneficial effect) is within 1-3° C. higher than ambient temperature, the latter being typically 4° C. (standard seabed temperature). However, note that the temperature can be more or less than 4° C. in certain areas.

In yet a preferred embodiment of the invention at least one of the above mentioned vehicles is/are used to operate/run one or more pumps within the cooling section and/or within the return line.

In yet a preferred embodiment of the invention the vehicle(s) further comprise(s) one or more wall-cleaning means arranged in contact with the outer circumference of its or their respective cooling flowline.

As mentioned above the invention also concerns a method for pig-free removal of wax and hydrate deposits in subsea hydrocarbon production flowlines. The method comprises the following steps:

- cooling the fluid in a cooling flowline over a cooling section until the fluid reaches a temperature at or near the cooling flowline's surrounding temperature,
- guiding a vehicle at least partly surrounding the outer circumference of the cooling flowline into or near the cooling section,
- initiating deposit removing means situated within the retrievable vehicle, the deposit removing means being configured to remove the deposits situated on the inner wall of the cooling flowline,
- guiding the vehicle over at least part of the cooling flowline a number of times in order to release deposited deposits from the surface of the inner wall, and optionally
- measuring the thickness of deposits within at least one of the at least one cooling flowline by use of known means such as temperature measurements, vibrational measurements, etc., preferably arranged within the respective vehicle.

The movement of the vehicle may be performed by an integrated propulsion unit, externally operated propulsion unit or a combination thereof. The vehicle is preferably retrievable and the deposit removing means may comprise heating means allowing heating of the inner walls of the cooling flowline and/or vibration means allowing vibrations exerted on the inner wall of the cooling flowline. In the latter case the frequencies of a major part of the vibrations set off by the vibration means preferably lie within the ultrasonic range. Furthermore, any heating of the inner wall by the at least one heating element may advantageously be performed by heating pulses of finite time durations in order to avoid melting of the deposits to be released. Note that heating element is defined as any means capable of heating a nearby object, for example by means of resistive heating or inductive heating.

The method may use any other features and combination of features specified in connection with the above disclosed plant.

By means of the invention may wax and hydrate deposits, etc., in hydrocarbon production flowlines be removed in an efficient manner, in particular for subsea production. The plant uses rapid cooling of the flow in the cooling section to assure long distance export of hydrocarbons below Wax Appearance Temperature (WAT) and at the same time ensures that deposits are continuously or frequently removed along the cooling sections.

The invention is applicable to any hydrocarbon flow, such as multiphase, oil, gas and condensate where deposits such as wax and hydrate might be a problem, and to other types of flow or production in pipes where deposits, debris or material sticking on the interior pipe walls may occur. Examples of such other fluid flows are water, coolants, fuels or sewage. The deposits may in principle be any dry or fatty particulates that are removable by means such as heating or vibration. Removal of deposits from fish feed pellets in distribution pipes is an example of alternative deposits.

In the cooling section, cooling may be further improved by actively forcing water (or air if on land) over the cooling pipes, by e.g. propellers, fans, etc. Circulation around the cooling pipes is enhanced by natural convection, and the cooling pipes may be arranged in an inclined configuration in order to further utilize this effect. Natural ocean currents may also be useful in the cooling process, e.g. by arranging the pipes transversely with respect to the currents. The pipes in the cooling section may also comprise a pipe-in-pipe arrangement where the well fluids flow in an inner pipe and cooling fluids flow in the annulus between the inner pipe and the outer pipe, preferably in the opposite direction of the well fluids. The length of the cooling section will depend on production volume and flow rates, as well as the contents and temperature of the fluid. The greater the number of parallel intermediate pipes is, the shorter the length of the cooling section may be.

If the vehicle is retrievable it may easily be replaced if malfunction occurs. The vehicle(s) may contain any kind of propulsion systems, wired and/or wireless. Electro magnets in the vehicle can be used for inductive heating in order to achieve the desired melting of hydrate or wax deposits formed on the pipe's inside walls. Plugs that clog the pipe entirely can also be melted, if they occur. In case of wired connection may power be provided via umbilical/tether from an adjacent unit, via cables on the sea floor or on reels, or via electricity passed through the pipes or rails on the pipes. The vehicle(s) may be rechargeable via docking/recharging stations at one or both ends of the cooling section, or distributed along the pipes, as an alternative to said direct or indirect powering by suitable umbilicals/tether cables.

The vehicle can be used as a platform for inspection of the pipelines and surrounding structures. Devices such as cameras, ultrasonic sensors, acoustic microphones, eddy current probes, temperature meters, distance meters, current and voltmeters might be mounted on the vehicle. In addition lights, lasers, position transponders and/or any communication system can be mounted. One or more ROV manipulator arms might also be mounted for better inspection and/or intervention work. A small ROV, mainly for inspection, might also be fitted for more inspection range. The ultrasonic sensors (or any other vibrational or optical sensors) may for example be used as a mean to measure wall thickness and other characteristics of deposit layers.

Moreover, the vehicle can be used to pull at least one internal object inside the pipe by locking to the internal object magnetically. The magnetic force can be provided through inductive spools or permanent magnets clamped on the outside or close to the outside of the pipe. In one embodiment the at least one internal object is a pump piston that can be used to boost production and/or to feed particles through the aforementioned return line. In a more preferred embodiment the plant comprises at least two internal objects such as pump pistons. The latter configuration may achieve a more even/steady flow since two or more objects/pistons allow an almost non-interrupting pumping performance by at least one of the pistons. In contrast, the operation of only one pump object/piston causes the fluid to flow more in gusts. The object(s)/piston(s) is/are preferably hollow in order to let fluid flow pass. Further, to ensure flow in one direction only, at least one one-way valve such as a flapper valve, ball valve or similar may be arranged at one or both ends of each object/pump, thereby improving production through pumping/pushing when the object(s)/piston(s) is/are moved in the flow direction, preferably with a speed significantly higher than the flow velocity. The valve(s) might be locked in an open or locked position if necessary. In the particular embodiment comprising multiple internal objects with one-way valves the objects may be allowed to pump sequentially, i.e. during the pumping of one object/pump, others are "charged" by being guided back to theirs (former or new) initial pumping position by means of the spools or permanent magnets mentioned above. The internal object(s) may be relocated to a parking position outside the cooling flowline(s), allowing maintenance and/or receiving/launching of other internal objects. The vehicle can be used as the retrievable magnetic spool/clamp to be placed on or by the pipe at any point. This magnetic clamp may act as an inductive pipe heater or (as indicated above) a magnetic field generator that propels the (magnetic) internal object within the pipe. Several magnetic clamps or vehicles can be mounted in series on a non-magnetic pipe and drive the internal object for longer distance inside the pipe. In the case that the internal object is a pump piston, the retrievable magnetic spools/clamps will work as a modular linear actuator or pump acting through the pipe wall. The stroke of the pump might be long or short, and, as explained above, two or more pump pistons can be moved in the same system to increase the pump effect. However, permanent inductive spools mounted on the pipe can do the same as the magnetic clamp described above. In both cases one or more magnetic spools might be placed around, parallel, arrayed, radially or axially to the pipe. The vehicle/clamp may also be a stationary, yet retrievable, spool comprising heat means and/or electromagnetic means for moving the at least one internal object.

The invention provides an efficient tool for removing ice from a pipe, both on the inside wall (by e.g. heating) and optionally on the outside wall (by any cleaning elements on the trolley). During normal operation the vehicle used in the inventive plant has limited or no use of support from external sources such as a support vessel or ROVs. Further the vehicle may be operated fully automatic with its own propulsion system, the latter being either self-driven, remotely controlled or a combination thereof. Finally, the operation may be either discretely or continuously.

BRIEF DESCRIPTION OF THE DRAWINGS

These and other characteristics of the invention will be clear from the following description of preferential forms of embodiment, given as non-restrictive examples, with reference to the attached schematic drawings wherein.

DETAILED DESCRIPTION OF A PREFERENTIAL EMBODIMENT

Figure 1:
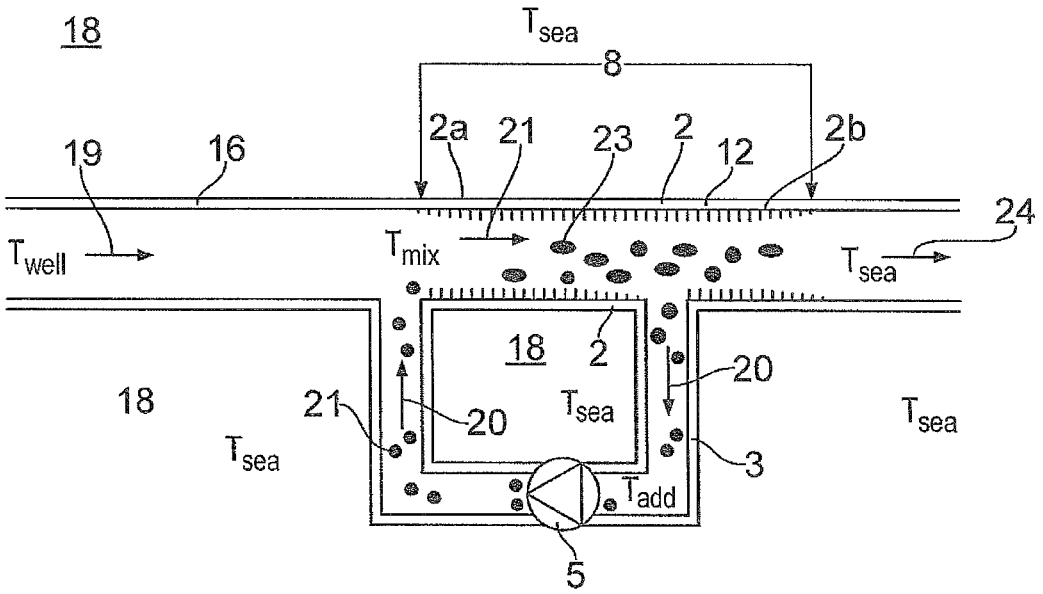
FIG. 1 (Prior Art)
FIG. 1 is a schematic illustration showing the principle of wax deposition and deposit removal using return line in accordance with prior art.

FIG. 1 shows the principle of wax deposition and deposit removal using a return line 3 with a dedicated pump 5. A feed flowline 16 situated in an ambience 18 such as seawater at a temperature $T_{sea}$ guides warm hydrocarbon well fluid 19 at temperature $T_{well}$ from a wellhead. A flowline 3 such as the return line 3 add a cooler additive fluid 20 at a temperature $T_{add}$ to the well flow 19. The additive fluid 20 may be the same fluid as the well fluid 19 or contain additives or seed particles 21. The mixture between the additive fluid 20 and the well fluid 19 forms a precipitating flow 22 having a mixture temperature $T_{mix}$. The additives 21 in the additive fluid 20 may promote the precipitation or crystallization of particles 23 in the well flow, which in the absence of the additive fluid 20 would have had a tendency of depositing on the inner wall 2*b* of the flowline 2. Further downstream of the flowline 2 the mixed fluid 22 obtains a temperature of or near the ambient temperature $T_{sea}$ and the precipitation comes to a halt, resulting in a cooled export flow 24. However, during the cooling of the precipitating flow some deposits 12 of the precipitating material 23 within the flow 22 will be deposited onto the inner walls 2*b* of the flowline 2. Hence, it is a need for means 11 to remove such deposits 12 located within a cooling section 8 of the relevant flowline 2, i.e. the section within the flowline 2 where deposits 12 are depositing on the inner walls due to the mainly intentional cooling.

Figure 2:
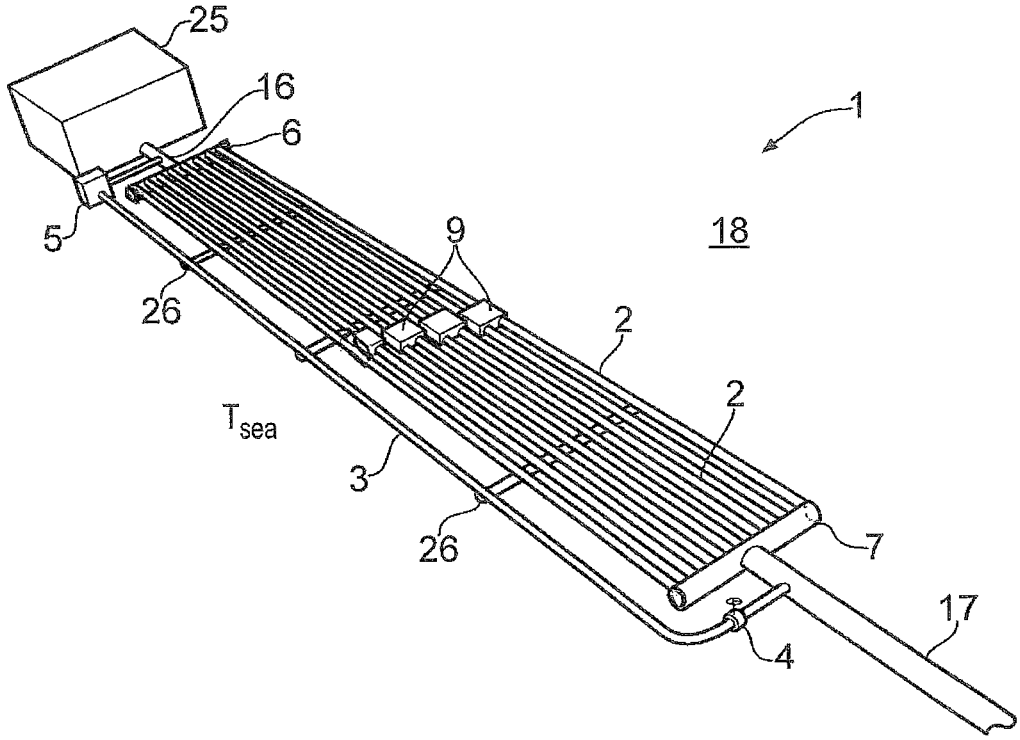
FIG. 2 is a perspective view of a fluid processing subsea plant in accordance with the invention with a cooling section and return line.
Figure 3:
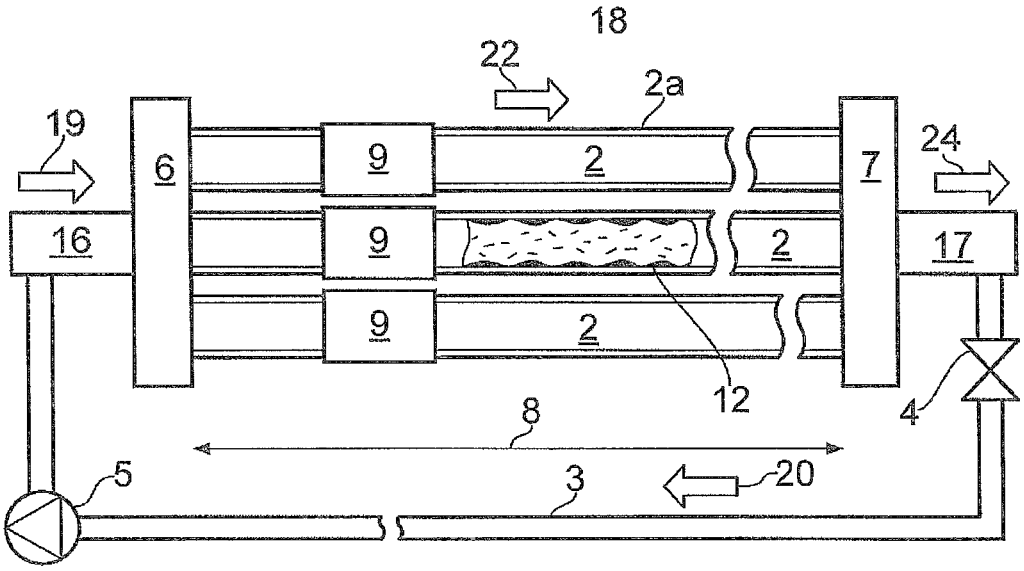
FIG. 3 is a top view of a part of the fluid processing subsea plant illustrated in FIG. 2, showing deposits within one of the cooling flowline.

FIG. 2 and FIG. 3 gives a perspective view and a top view, respectively, of at least a part of fluid processing plant 1 in accordance with one embodiment of the invention. The plant 1 comprises a line supporting frame 26 resting on a seabed, a feed flowline 16, an export flowline 17, a plurality of cooling flowlines 2 situated between the feed flowline 16 and the export flowline 17, a return line 3 guiding a fraction of the fluid in the export flowline 17 back to the feed flowline 16 and a so-called Pipeline End Manifold (PLEM) 25 (FIG. 2 only) receiving well fluids 19 from e.g. wellheads, satellites, etc. (not shown).

The return line 3 is equipped with a valve 4 and a pump 5 in order to control the fraction of the fluid flow. The transition from the feed flowline 16 to the multiple cooling flowlines 2, and the transition from the multiple cooling flowlines 2 to the export flowline 17, is controlled by an inflow manifold 6 and an outflow manifold 7, respectively. Comparably warm well fluids 19 are fed from subterranean reservoirs into the cooling flowlines 2. Here, heat exchange with the ambient seawater 18 takes place by thermal convention through the walls of the flowlines. When the fluids reach the outflow manifold 7, the temperature of the well fluids is ideally on the same level as the temperature of the seawater ($T_{sea}$), and the cooler well fluids 24 are fed into the export flowline 17. The efficiency of the heat exchange will increase with the number of the cooling flowlines 2 and its individual dimensions. The cooling flowlines 2 are in FIGS. 2 and 3 shown in a parallel configuration. However, other configurations are possible such as stacked, mutually and/or individually helical, mutually and/or individually elevated, or a combination of these configurations. During the operation of the processing plant 1, a dedicated vehicle 9 is moved back and forth on the outer circumference 2*a* of the cooling flowline 2 in order to remove the inside deposits 12 (FIG. 3 only) of the cooling pipes 2 using vehicle integrated or coupled deposit removing means 11 (see FIGS. 4*a* and 4*b*), for example heating elements 11 and/or ultrasonic transducers 11. As explained above in connection with FIG. 1,the illustrated return line 3 with its pump 5 and valve 4 will further contribute to the cooling of the warm well fluid 19 by means of reinserting the cooled fluid 24 exiting the cooling flowline 2 back into the well fluid 19, optionally with appropriate additives or seed particles 21 added.

Figure 4A:
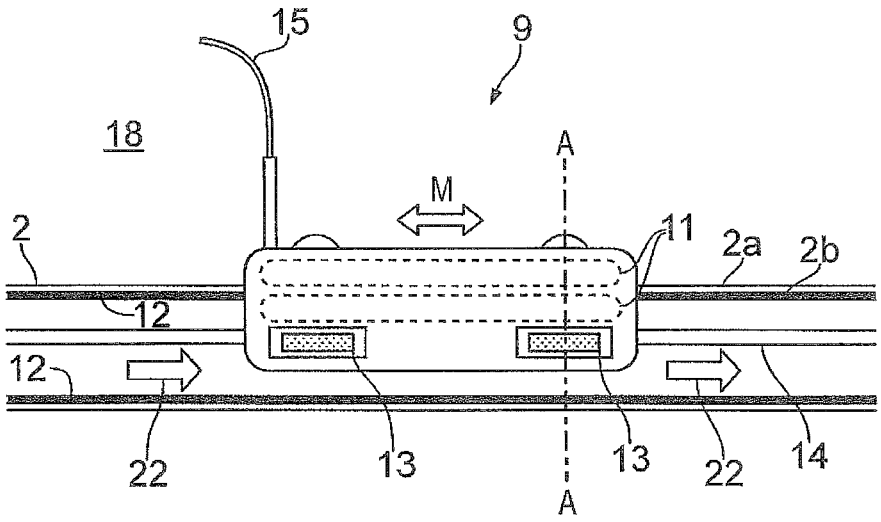
FIGS. 4*a* and 4*b* are a radial view and an axial view of a part of a cooling flowline and a vehicle used in the fluid processing subsea plant in accordance with the invention.
Figure 4B:
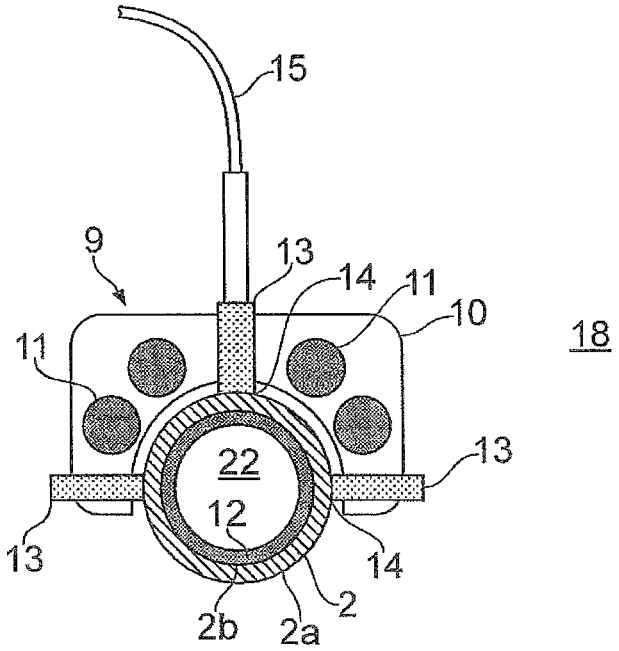

An example of a vehicle 9 that may be used with the inventive plant 1 is illustrated in FIGS. 4*a* and 4*b* in a radial view and axial view, respectively, relative to the direction of the cooling flowline 2. The vehicle 9 is arranged in order to at least partly enclose the outside pipe wall 2*a* of the cooling flowline 2 within a complementary semi-cylindrical recess. The support onto the pipe 2 is achieved by two rollers or wheels 13 arranged on diagonally opposing sides of the pipe 2, enabling movements in either direction along the pipe 2 (indicated by double arrow M in FIG. 4*a*). External cleaning elements (wipers, brushes, or bristles) may conveniently be arranged at both ends of the vehicle 9 in order to sweep away debris, fouling and/or ice on the outside of the pipe 2 which otherwise might impede the vehicle's 9 movements along the pipe 2. Such cleaning of the pipe exterior 2*a* also improves the heat-exchange between the fluids 22 in the pipe 2 and the surroundings 18 (i.e. air if on land, seawater if subsea). The external cleaning elements may be extended in a circumferential and/or longitudinal direction in order to sweep a greater surface area of the outer pipe wall 2*a*. Deposits 12 to be removed are shown (FIG. 4*b*) in form of a layer covering the inside wall 2*b* of the pipe 2. Furthermore, heating elements and/or ultrasonic tranducers 11 for removing the deposits 12 are shown as four bars arranged within the vehicle, along the axial direction of the pipe 2.

The wheels 13 are in the illustrated embodiment driven by an electric motor which may be powered by on-board batteries or from an external source via an umbilical 15. The wheels 13 may be rubber wheels, rolling directly on the pipe outer wall. The wheels 13 may also be gear wheels, rolling in a pitch rack 14 in a rack-and-pinion configuration. Other propulsion units may for example be based on various winch and/or thruster configurations.

Figure 5:
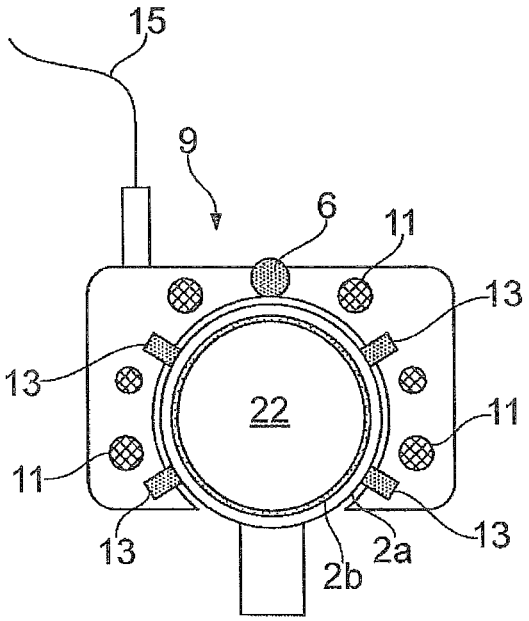
FIG. 5 is an axial view of a part of the cooling flowline and a second vehicle used in the fluid processing subsea plant in accordance with the invention.

FIG. 5 shows a second embodiment involving a second vehicle 9 enclosing a larger part of the outside pipe wall 2*a*. The second vehicle comprises here two parts separated by a pivotable hinge connection 6. Furthermore, four wheels 13 are arranged symmetrically or near symmetrically around the circumference of the pipe 2 in order to obtain a higher operational stability of the vehicle movements. However, the invention includes any distribution of the wheels that may assist the desired longitudinal vehicle movement.

Figure 6A:
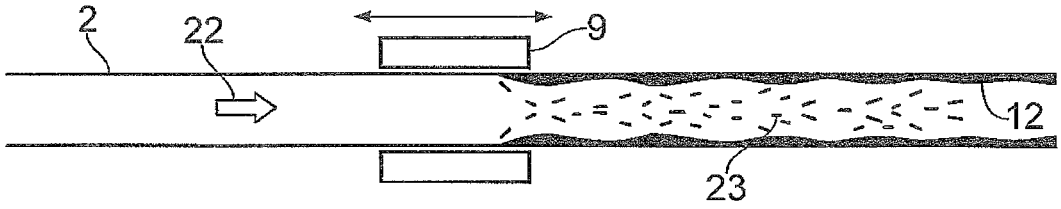
FIGS. 6*a* and 6*b* are a radial view and an axial view of a part of the cooling flowline and the vehicle of FIGS. 4*a* and 4*b*, including illustrations of deposits within the cooling flowline.
Figure 6B:
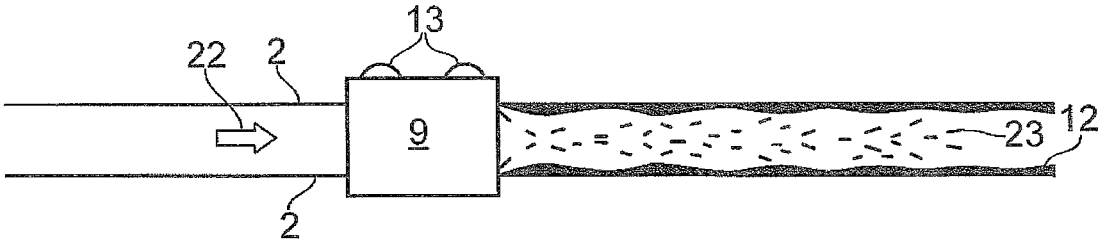

Schematic presentations of the above mentioned first or second vehicle 9 during operation are shown in FIGS. 6*a* (top, cross sectional view) and 6*b* (radial view), providing an illustration of the removal process of deposits from the inner wall of the pipe/cooling flowline 2, thus creating precipitated particles that are being washed away by the flow of the mixed fluid 22.

Figure 7:
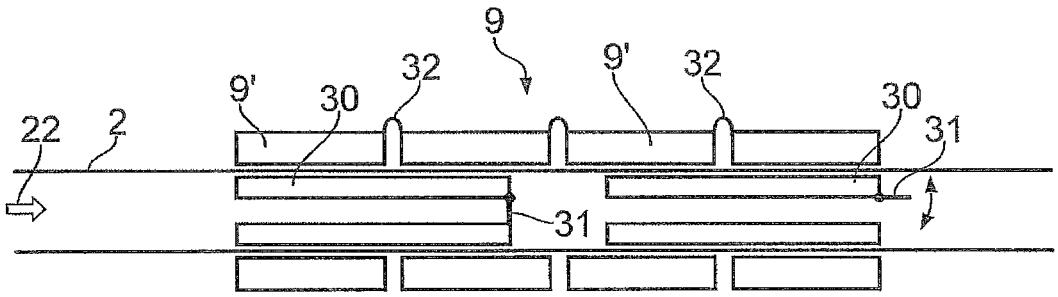
FIG. 7 is a radial view of a part of the cooling flowline, a third vehicle and two internal pump pistons arranged in series.

FIG. 7 shows a top view of another embodiment of the invention, where at least one of the vehicle 9, referred to as a third vehicle, constitutes a clamp system comprising one or more magnetic spools/clamps 9' arranged in a retrievable manner along the pipe and mutually connected by dedicated links 32. The required power and communication signals may be distributed throughout the entire clamp system 9,9' through dedicated cables 15 forming part of, or arranged together with said links 32. Moreover, two pump pistons 30 are in this embodiment arranged inside the pipe 2 that may be driven longitudinally by locking magnetically to the outside clamp system 9,9', i.e. the retrievable clamps 9' work as a modular linear actuator or pump acting through the pipe wall 2. The magnetic force can be provided by means of inductive spools or permanent magnets. A one-way pivotable valve 31 is arranged at one longitudinal end of the two pump pistons 30 and configured such that it stays in a closed position when the pistons 30 are moving faster than the flow 22 relative to the flow direction and in an open position when the pistons 30 are moving slower than, or opposite to, the flow 22 relative to the flow direction. Consequently the pistons 30 may improve the production by pumping/pushing the fluid 22, preferably with a speed significantly higher than the flow velocity. If required the pistons 30 may also allow the flow 22 to pass through by the implementation of the valve 31. As explained above an improved effect is achieved when the two (or more) pump pistons are configured to perform a reciprocally alternating pumping act. In this particular embodiment the pipe walls are non-magnetic or near non-magnetic. The pump pistons 30 may be relocated to a parking position outside the cooling section 8, enabling maintenance and/or receiving/launching of other pump pistons. The magnetic clamp(s) may also act as an inductive pipe heater. The total clamp system 9,9' may be stationary arranged on the pipe and/or scaleable.

Other embodiments of the vehicle 9 may be found in the publication WO 2012/093079 which is hereby included by reference.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention.

The invention claimed is:

1. A fluid flow processing plant for pig-free removal of wax and hydrate deposits in hydrocarbon production flowlines, the fluid flow processing plant comprising:

a plurality of cooling flowlines, wherein the plurality of cooling flowlines are arranged in a parallel configuration;

cooling means arranged to cool a fluid in each cooling flowline over a cooling section until the fluid reaches a temperature at or near an ambient temperature of the fluid flow processing plant; and at least one dedicated vehicle arranged on or near an outer circumference of at least one of the plurality of cooling flowlines, wherein the at least one dedicated vehicle is dedicated to the fluid flow processing plant such that an extent of movement of the at least one dedicated vehicle is restricted by one or more of the plurality of cooling flowlines in normal operation of the fluid flow processing plant, wherein each vehicle comprises:

at least one sleeve configured to at least partly surround the outer circumference of the at least one of the plurality of cooling flowlines;

deposit removing means being configured to remove deposits situated on an inner wall of the at least one of the plurality of cooling flowlines such that, in the normal operation of the fluid flow processing plant, blockages of the at least one of the plurality of cooling flowlines formed by deposits are prevented from occurring; and a propulsion unit configured to drive the vehicle bi-directionally on the at least one of the plurality of cooling flowlines in the normal operation of the fluid flow processing plant, wherein the deposit removing means includes heating means configured to heat the inner walls of the at least one of the plurality of cooling flowlines, thereby allowing heat induced removal of the deposits.

2. The fluid flow processing plant according to claim 1, wherein the deposit removing means comprises vibration means, the vibration means being configured to cause vibrations of the inner wall of the at least one of the plurality of cooling flowlines, thereby allowing vibration induced removal of the deposits.

3. The fluid flow processing plant according to claim 1, further comprising:

a feed flowline fluidly connectable to a fluid reservoir; and an export flowline, wherein the at least one cooling flowline establishes fluid communication between the feed flowline and the export flowline.

4. The fluid flow processing plant according to claim 1, wherein the plurality of cooling flowlines are configured in a combination of stacked and parallel thereof.

5. The fluid flow processing plant according to claim 1, wherein the plurality of cooling flowlines are connected to the feed flowline and the export flowline via an inlet manifold and an outlet manifold, respectively.

6. The fluid flow processing plant according to claim 1, wherein the fluid flow processing plant is supported on a seabed below a body of water and connected in fluid communication with one or more subterranean fluid reservoirs producing a hydrocarbon containing flow having a temperature that is higher than an ambient seawater temperature.

7. The fluid flow processing plant according to claim 3, further comprising:

a return line fluidly connected between the export flowline and the feed flowline.

8. The fluid flow processing plant according to claim 1, wherein the heating means is configured to heat the inner wall by heat pulses of finite time durations.

9. The fluid flow processing plant according to claim 8, the time durations of the heat pulses are set to be long enough to remove a major part of the deposits from the inner wall within the cooling section.

10. The fluid flow processing plant according to claim 8, wherein the time durations of the heat pulses are short enough to avoid any substantial melting of a major part of the deposits within the cooling section.

11. The fluid flow processing plant according to claim 1, wherein each vehicle is retrievably connected to the outer circumference of the at least one of the plurality of cooling flowlines by at least one hinged sleeve.

12. The fluid flow processing plant according to claim 1, wherein the fluid flow processing plant is configured to provide cold flow subsea transport of hydrocarbons.

* * * * *